US008061369B2

(12) United States Patent
Kim

(10) Patent No.: US 8,061,369 B2
(45) Date of Patent: Nov. 22, 2011

(54) HAIR CLIP FOR BEAUTY SHOP

(76) Inventor: Chan-Soo Kim, Seoul (KR)

( * ) Notice: Subject to any disclaimer, the term of this patent is extended or adjusted under 35 U.S.C. 154(b) by 180 days.

(21) Appl. No.: 12/374,990

(22) PCT Filed: Oct. 26, 2007

(86) PCT No.: PCT/KR2007/005296

§ 371 (c)(1),
(2), (4) Date: Jan. 23, 2009

(87) PCT Pub. No.: WO2008/051042

PCT Pub. Date: May 2, 2008

(65) Prior Publication Data

US 2009/0194131 A1 Aug. 6, 2009

(30) Foreign Application Priority Data

Oct. 26, 2006 (KR) ..... 10-2006-0104471

(51) Int. Cl.
*A45D 8/20* (2006.01)

(52) U.S. Cl. ..... 132/277; 24/510; 24/507

(58) Field of Classification Search ..... 132/273–284; 24/510, 490, 492, 495, 507
See application file for complete search history.

(56) References Cited

U.S. PATENT DOCUMENTS

| | | | | |
|---|---|---|---|---|
| 5,365,955 | A | 11/1994 | Desgroux | |
| 6,386,206 | B2 | 5/2002 | Lee | |
| 7,093,376 | B2 | 8/2006 | Regen | |
| 7,461,662 | B2 * | 12/2008 | Kim | 132/277 |

FOREIGN PATENT DOCUMENTS

KR 10-2002-0082088 A 10/2002

* cited by examiner

*Primary Examiner* — Todd Manahan
*Assistant Examiner* — Brianne O'Neill
(74) *Attorney, Agent, or Firm* — John K. Park; Park Law Firm

(57) ABSTRACT

A hair clip for beauty shop, designed to clip hair to be cared and to maintain its shape. The hair clip comprises a finger installed to be able to rotate with the elasticity from an upper clip piece and so to support a pressing member toward a lower clip piece, and a soft pressing member installed to be connected to the upper clip piece and the finger. The hair clip can clip firmly hair positioned on the upper part of the lower clip piece and so prevent the hair from falling away from the hair clip in process of hair care.

5 Claims, 7 Drawing Sheets

[Fig. 1]
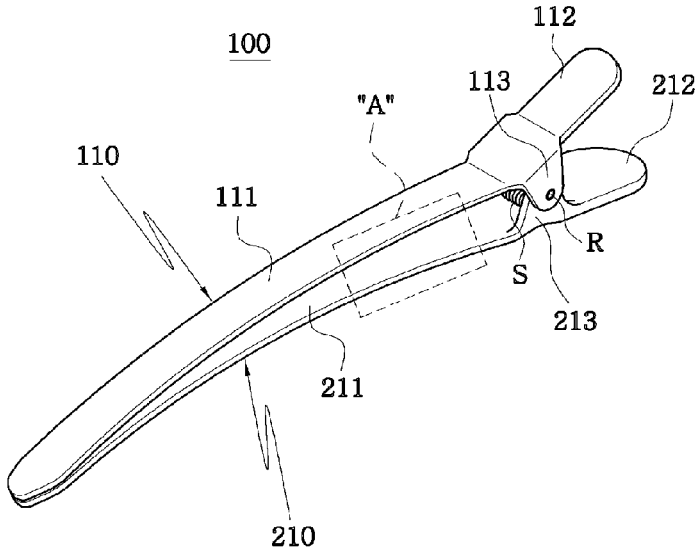
[Fig. 2]
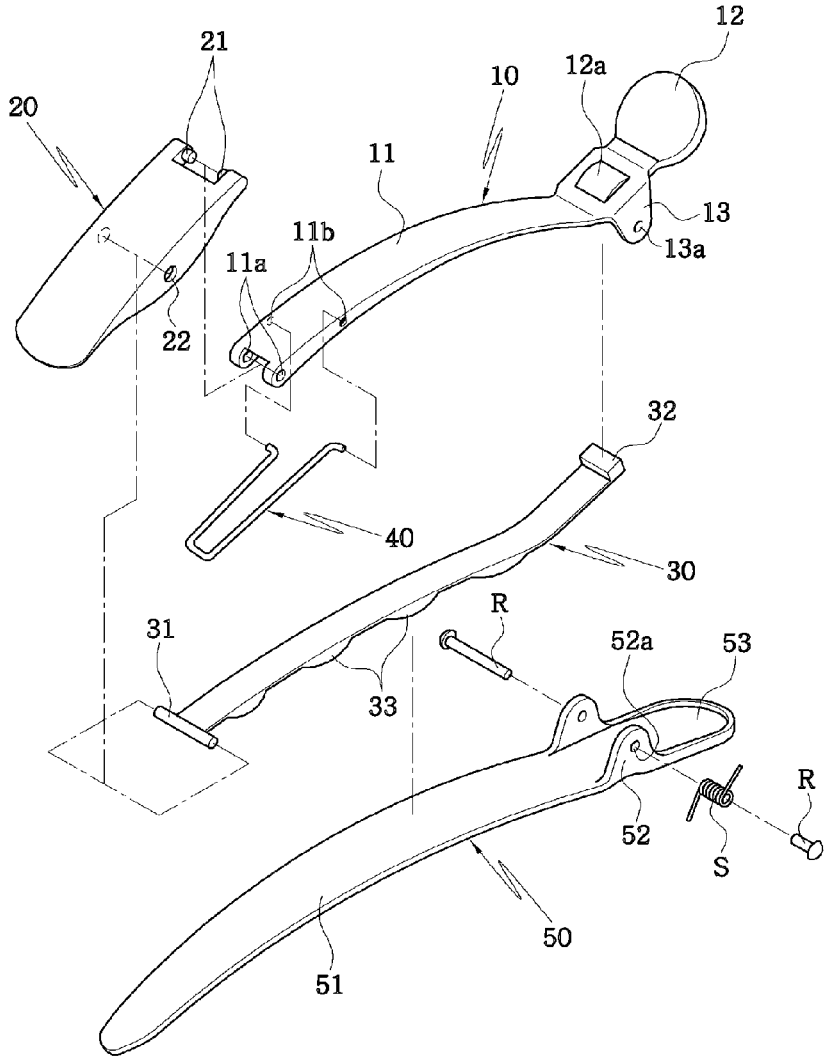

[Fig. 3]
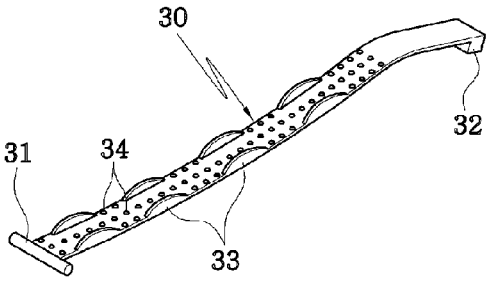
[Fig. 4]
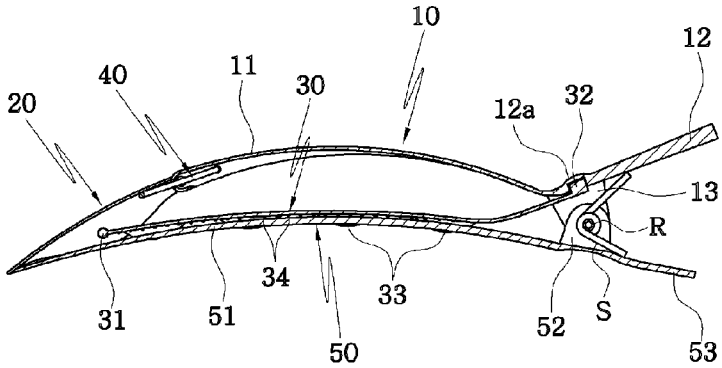
[Fig. 5]
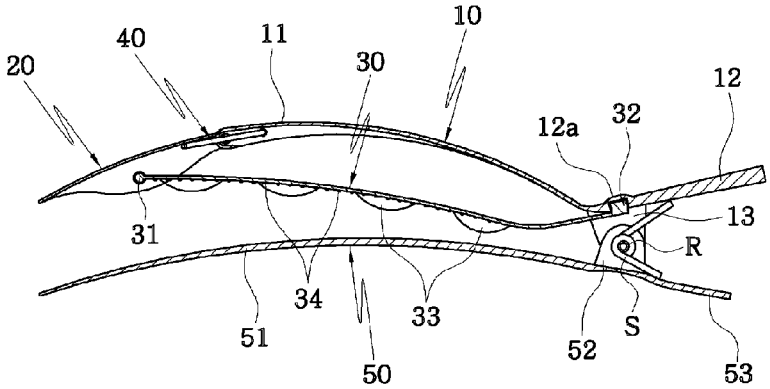
[Fig. 6]
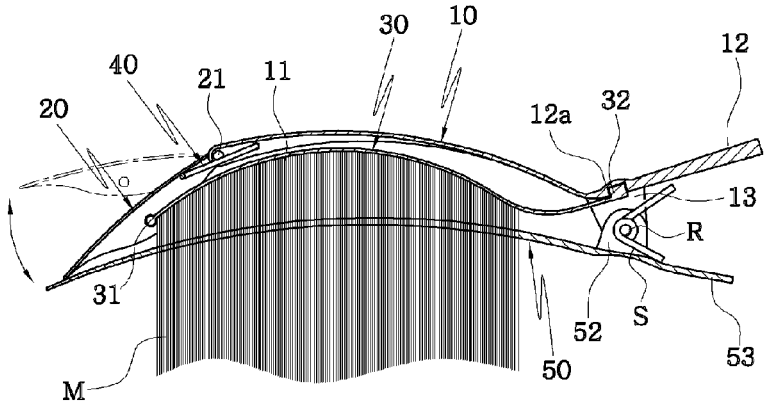

[Fig. 7]
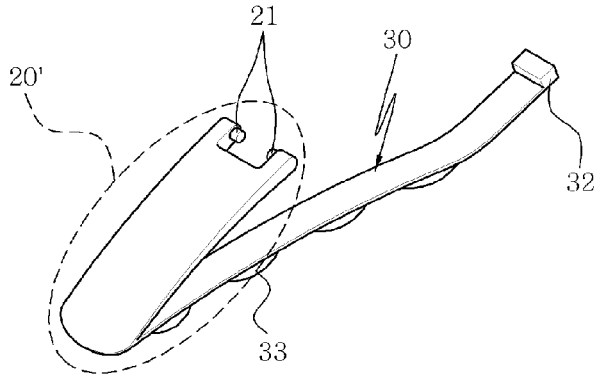
[Fig. 8]
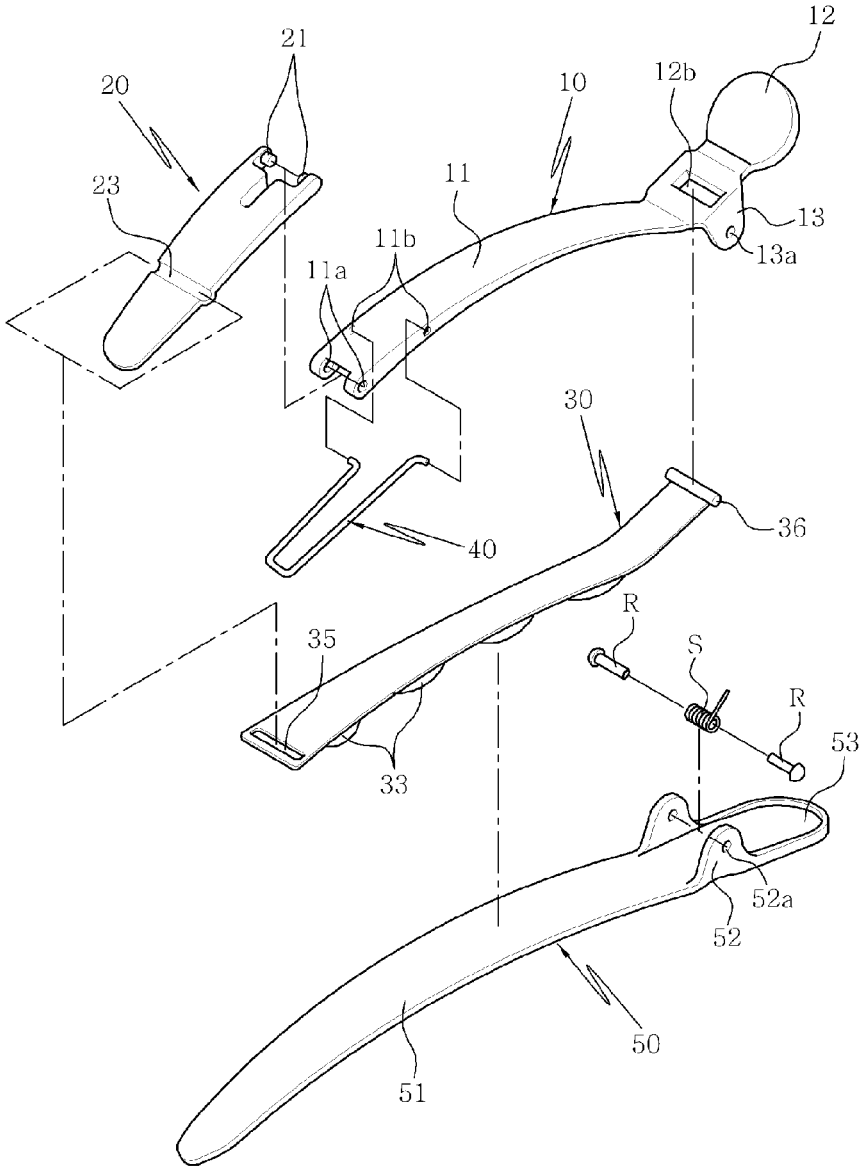

[Fig. 9]
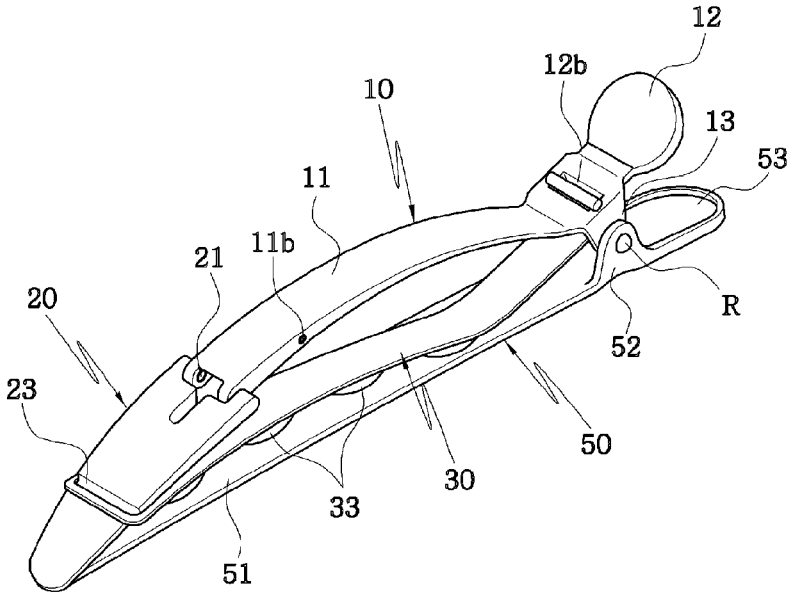
[Fig. 10]
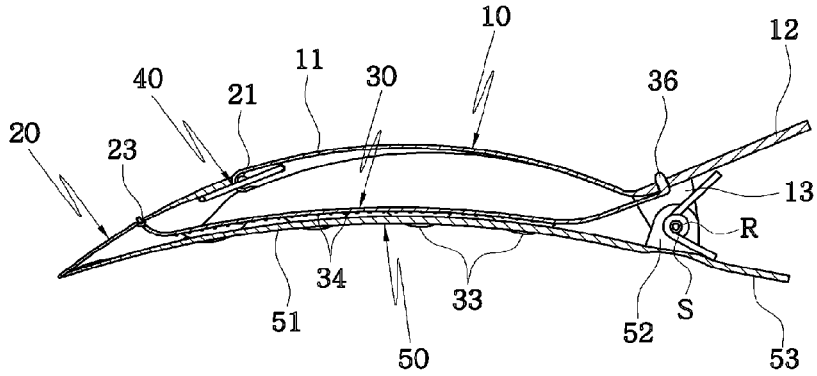
[Fig. 11]
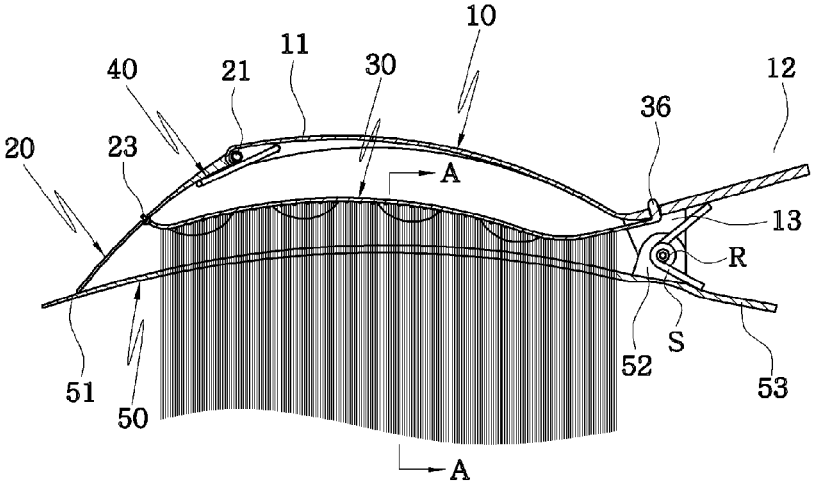

[Fig. 12]
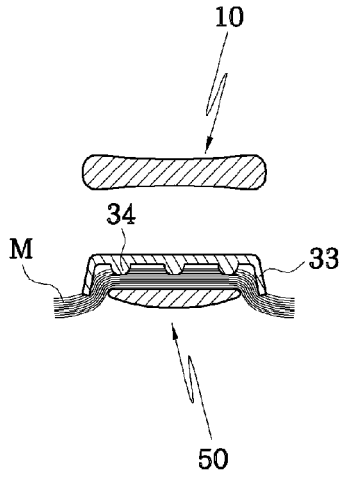
[Fig. 13]
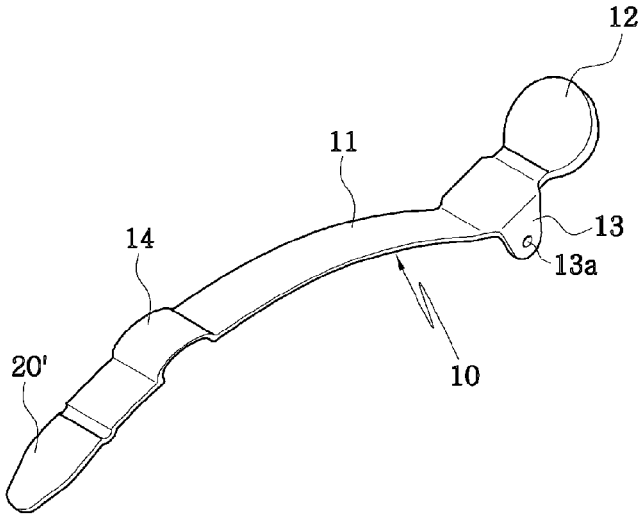
[Fig. 14]
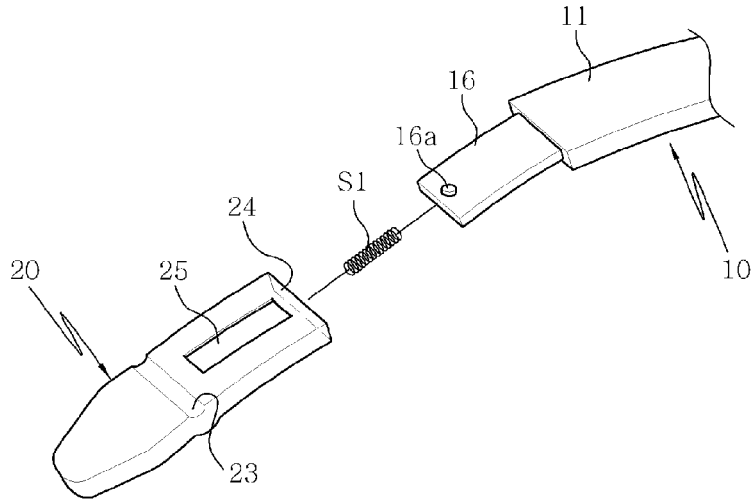

[Fig. 15]
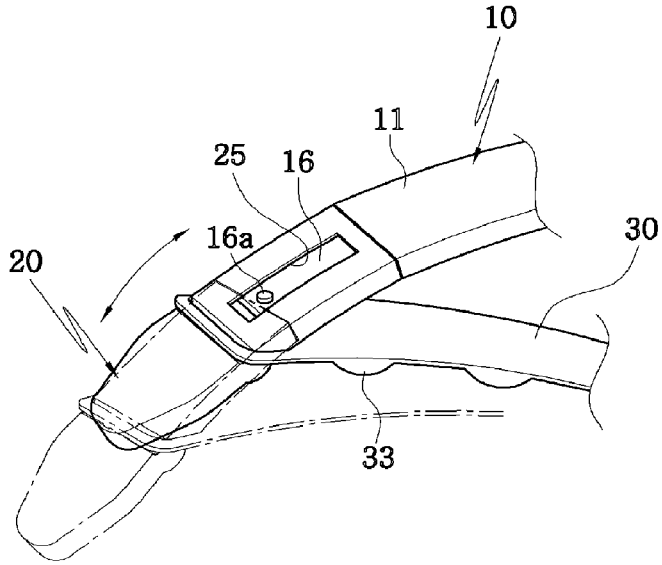
[Fig. 16]
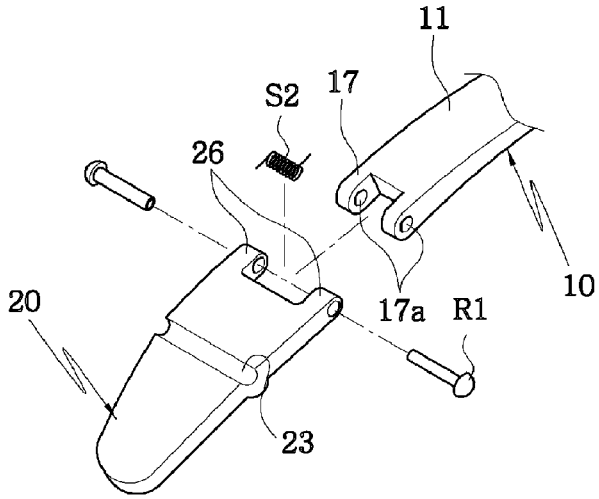
[Fig. 17]
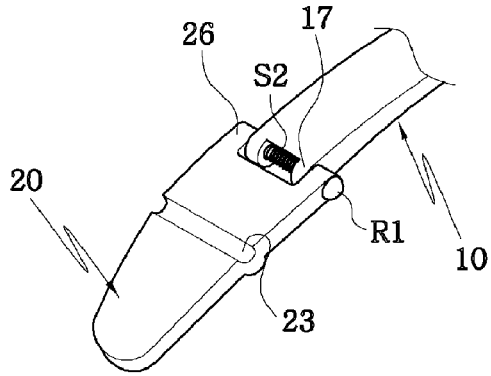

[Fig. 18]
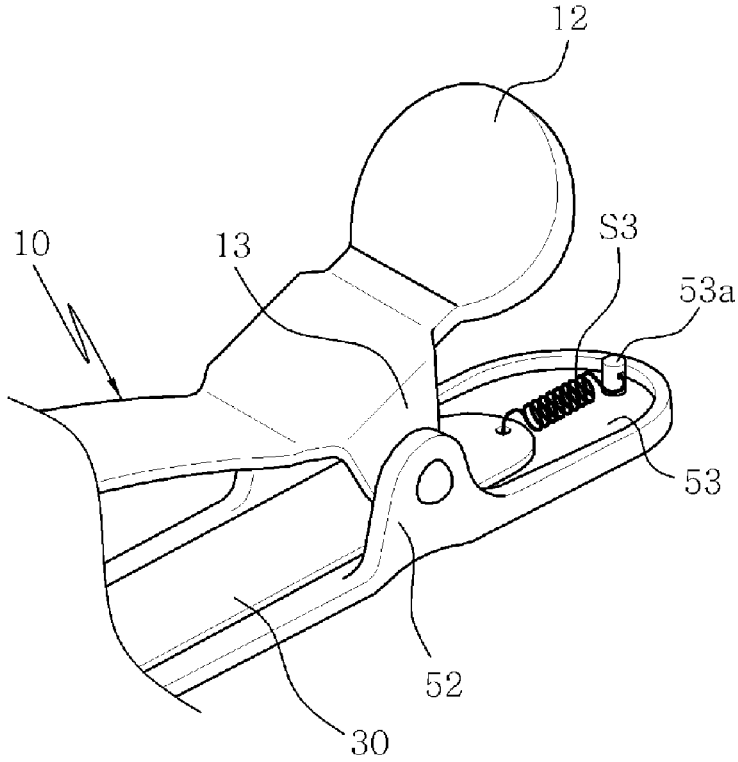
[Fig. 19]
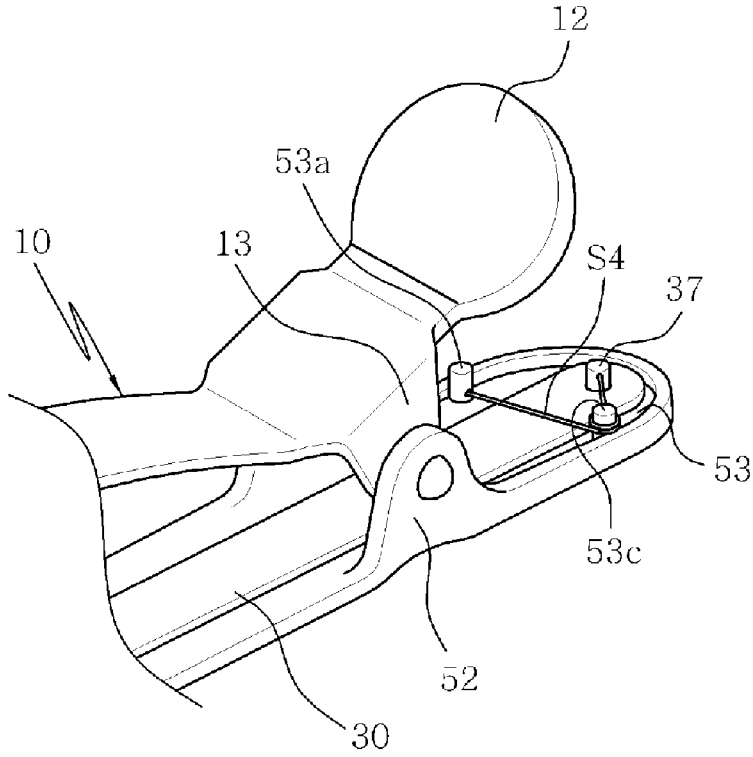

HAIR CLIP FOR BEAUTY SHOP

TECHNICAL FIELD

The present invention relates to a hair clip for beauty shop, more particularly to a hair clip by which beauty work of hair can be conducted more conveniently through fixing selected hair more firmly and preventing them from falling away from the hair clip by improving the clamping structure of a hair clip being used temporally in beauty shop to trim hair or maintain their shape.

BACKGROUND ART

In general, a hair clip having a long clip to hold selected hair is used to conduct such beauty work as cutting, dyeing of hair at home or in beauty shop.

Said hair clip(100) is divided into an upper clip piece and a lower clip piece, and taking the curve of our head into consideration like in an attached FIG. 1, the upper clip piece(110) has such a structure that a bracket(113) formed from the border line between the curvature portion(111) and the pressing plate(112) is formed in one united body with a pressing plate(112) having a curve-shaped curvature portion, a curvature portion(111).

Said lower clip piece(210) having a shape corresponding to the upper clip piece(110) has a structure formed in one united body with a curvature portion(211), a pressing plate(212) and a bracket(213) corresponding to the bracket(113) from the border line between the curvature portion(211) and the pressing plate(212).

A rivet(R) is installed through the connection hole passing through each of brackets(113), (213), and on the axis of the rivet(R) a torsion spring(S) is installed in order to impart the elasticity to the upper clip piece(110) and the lower clip piece(210) like at a conventional type of nipper.

On the other hand, the curvature portion(211) of the lower clip piece(210) get the bigger gap to the curvature portion (111) of the upper clip piece(110), the nearer it goes to the pressing plate(212), depending on the formation and installation of each of brackets (see the A part in Drawings).

Said conventional hair clip(100) has long curvature portions(111)(211) and so it has following problem in selecting and holding hair from the head.

In regard to the length of the curvature portions of the upper clip piece and the lower clip piece, an one end part of the curvature portion having good contact has good selection of hair, but the more it goes to the rear direction, the weaker the force holding hair becomes due to the shape of the brackets.

For this reason, one part of selected hair can fall away and so the hair become easily disheveled. After all, the conventional hair clip brings about difficulty when a worker trim or dye hair and then worker has to use another hair clip additionally to solve this difficulty.

DISCLOSURE OF INVENTION

Technical Problem

Therefore, in order to overcome such drawbacks of the prior art, an objective of the present invention is to improve a holding structure of a hair clip used temporally in hair shop in order to trim hair or maintain shape of hair and then to hold selected hair more firmly and so to prevent hair from falling away from hair clip and to provide a hair clip enabling to conduct more easily hair care.

Technical Solution

To accomplish the objective of the present invention and other advantages and in accordance with the purpose of the present invention, there is provided a hair clip for beauty shop comprising, an upper clip piece having; hinge holes on the both sides of a curve-shaped first curvature portion, spring support holes in that length direction, a pressing plate in opposite direction to the first curvature portion, a protrusion being caved from the bottom surface of one side of the pressing plate and at the same time protruding to the upper direction, and brackets having joint holes on the both sides; a finger having; rotatable fixed shafts formed facing each other inserted into both sides of the hinge holes of the upper clip piece on its one end portion, support holes on both side; a pressing member with belt shape having; a support protuberance axis, both end side of which can be caught and supported by the support holes of the finger on the one hand, a support projection, on the opposite end of the support protuberance axis, which are guided and supported to the bottom surface of the protrusion of the upper clip piece, a number of support convex parts for holding hair on the bottom surface of the length direction; a variable spring, the both ends of which are mounted in the spring support holes of the upper clip piece and the one end of which is supported closely on the bottom surface of the finger and supports elastically the rotation of the finger according to the volume of the selected hair; a lower clip piece having; a curve-shaped second curvature portion corresponding to the upper clip piece, brackets with a torsion spring installed elastically and rotatably to the brackets of the upper clip piece on one side of the second curvature portion and joint holes, through which a rivet pass and can be jointed, a supporting plate corresponding to the pressing plate of the upper clip piece.

Further, a hair clip for beauty shop comprises an upper clip piece having; hinge holes on the both sides of a curve-shaped first curvature portion, spring support holes in that length direction, a pressing plate in opposite direction to the first curvature portion, an insertion hole on one side of the pressing plate, and brackets having joint holes on the both side; a finger having; rotatable fixed shafts formed facing each other inserted into both sides of the hinge holes of the upper clip piece on its one end portion, a catching part formed caved on the length direction; a pressing member with belt shape having; a joint hole inserted into the end portion of the finger from the one end portion of the pressing member and caught to be supported by the catching part, a support protuberance axis, on the opposite end of the pressing member, which is passed through an insertion support hole of the upper clip piece and supported by it, a number of support convex parts for holding hair on the bottom surface of the length direction; a variable spring, the both ends of which are mounted in the spring support holes of the upper clip piece and the one end of which is supported closely on the bottom surface of the finger and support elastically the rotation of the finger according to the volume of the selected hair; a lower clip piece having; a curve-shaped second curvature portion corresponding to the upper clip piece, brackets with a torsion spring installed elastically and rotatably to the brackets of the upper clip piece on one side of the second curvature portion and joint holes, through which a rivet pass and can be jointed, a supporting plate corresponding to the pressing plate of the upper clip piece.

Advantageous Effects

As described above, a hair clip for a beauty shop according to the present invention, designed to clip hair to be cared and to maintain its shape, comprises a finger installed to be able to rotate with the elasticity from an upper clip piece and so to support a pressing member toward a lower clip piece, and a soft pressing member installed to be connected to the upper clip piece and the finger. The hair clip can hold firmly hair positioned on the upper part of the lower clip piece and so prevent the hair from falling away from the hair clip in process of hair care.

Further, the production cost of the hair clip can be reduced by forming the finger in one united body to the pressing member.

Furthermore, more stable holding of hair can be realized by installing elastically the tension coil spring or the torsion spring to the rear end of the pressing member from the supporting plate of the lower clip piece, and so the beauty service for hair can be conducted much easier.

BRIEF DESCRIPTION OF THE DRAWINGS

FIG. 1 is a perspective view illustrating a hair clip according to a conventional technique, FIG. 2 is an exploded perspective view of a hair clip according to the present invention, FIG. 3 is a perspective view illustrating a bottom surface of a pressing member of the hair clip according to the present invention, FIG. 4 is an longitudinal sectional view illustrating an assembled state of the hair clip according to the present invention, FIG. 5 is an longitudinal sectional view illustrating an opened state of the hair clip according to the present invention, FIG. 6 is an longitudinal sectional view illustrating a state of hair clipped through the hair clip according to the present invention, FIG. 7 is a perspective view illustrating an exemplary embodiment of a state that a finger is formed in one united body to a pressing member of the hair clip according to the present invention, FIG. 8 is an exploded perspective view of an exemplary embodiment of the hair clip according to the present invention, FIG. 9 is a perspective view illustrating the hair clip in FIG. 8, FIG. 10 is a longitudinal sectional view illustrating the hair clip in FIG. 8, FIG. 11 is an longitudinal sectional view illustrating a state of hair clipped through the hair clip in FIG. 8, FIG. 12 is a A-A line sectional view of the hair clip in FIG. 11, FIG. 13 is an perspective view illustrating a state that a finger is formed in one united body to an upper clip piece of the hair clip according to the present invention, FIGS. 14-17 are a perspective view illustrating an exemplary embodiment of a connection structure of a finger and an upper clip piece of the hair clip according to the present invention.

FIGS. 18-19 are partial perspective views illustrating a state that a pressing member of the hair clip according the present invention is installed on the lower clip piece elastically.

MODE FOR THE INVENTION

Hereinafter, a preferred embodiment of the present invention will be described with reference to the attached FIGS. 2-19 more in detail.

FIG. 2 is an exploded perspective view of the hair clip according to the present invention, and FIG. 3 is a perspective view illustrating a bottom surface of a pressing member of the hair clip according to the present invention, and FIG. 4 is a longitudinal sectional view illustrating an assembled state of the hair clip according to the present invention.

A hair clip for beauty shop(1) according to the present invention is composed of an upper clip piece(10), a finger(20) being capable of rotating partly from the upper clip piece, a pressing member(30) coupling the upper clip piece(10) to the finger(20), a variable spring(40) and a lower clip piece(50).

An upper clip piece(10) has hinge holes(11*a*) on the both sides of a curve-shaped first curvature portion(11), spring support holes(11*b*) in that length direction, a pressing plate (12) in opposite direction to the first curvature portion(11), a protrusion(12*a*) being caved from the bottom surface of one side of the pressing plate(12) and at the same time protruding to the upper direction, and brackets(13) having joint holes (13*a*) on the both sides.

A finger(20) has rotatable fixed shafts(21) formed facing each other inserted into both sides of the hinge holes(11*a*) of the upper clip piece(10) on its one end portion, support holes (22) on both sides;

A pressing member(30) with belt shape has a support protuberance axis(31), both end side of which can be caught and supported by the support holes (22) of the finger(20) on the one hand, a support projection(32), on the opposite end of the support protuberance axis(31), which are guided and supported to the bottom surface of the protrusion(12*a*) of the upper clip piece(10), a number of support convex parts(33) for holding hair on the bottom surface of the length direction.

Further, the pressing member(30) comprises support convex parts(33) at regular intervals formed in curved-shape, and a number of hemispheric protrusions(34) protudly formed in the bottom surface of the length-direction in order to hold firmly hair.

Furthermore, the variable spring(40) is formed in U-shape and the lengths of each parts of the variable spring are formed differently, and the both ends of it are formed in the spring support holes(11*b*) of the upper clip piece(10), and the one end is supported closely on the bottom surface of the finger (20) in order to support elastically the rotation of the finger (20) according to the volume of selected hair.

A lower clip piece(50) corresponding to the upper clip piece(10) has a curve-shaped second curvature portion(51), brackets(52) with a torsion spring(S) installed elastically and rotatably to the brackets(13) of the upper clip piece(10) on one side of the second curvature portion(51) and joint holes (52*a*), through which a rivet(R) pass and can be jointed, a supporting plate(53) corresponding to the pressing plate(12) of the upper clip piece(10).

FIG. 7 is an perspective view illustrating an exemplary embodiment of a state of the hair clip according to the present invention.

Here, a finger can be formed in one united body to one end of a pressing member of the hair clip according to the present invention.

FIG. 8 is an exploded perspective view of an exemplary embodiment of the hair clip according to the present invention, and FIG. 9 is a perspective view illustrating the hair clip in FIG. 8 according to the present invention, and FIG. 10 is a longitudinal sectional view illustrating the hair clip in FIG. 8 according to the present invention.

An upper clip piece(10) has hinge holes(11*a*) on the both sides of a curve-shaped first curvature portion(11), spring support holes(11*b*) in that length direction, a pressing plate (12) in opposite direction to the first curvature portion(11), an insertion hole(12*b*) on one side of the pressing plate(12) and brackets(13) having joint holes(13*a*) on the both sides.

A finger(20) connected to the one end of the upper clip piece(10) has rotatable fixed shafts(21) formed facing each other inserted into both sides of the hinge holes(11*a*) of the upper clip piece(10) on its one end portion, a catching part (23) formed caved on the length direction.

A pressing member(30) with belt shape has a joint hole(35) inserted into the end portion of the finger(20) from the one end portion of the pressing member and caught to be supported by the catching part(23), a support protuberance axis (36), on the opposite end of the pressing member, which is passed through an insertion support hole(12*b*) of the upper clip piece(10) and supported by it, a number of support convex parts(33) for holding hair on the bottom surface of the length direction.

Further, a variable spring(40) is installed from the upper clip piece(10) and the finger(20). The variable spring(40), the both ends of which are mounted in the spring support holes (11*b*) of the upper clip piece(10) and the one end of which is supported closely on the bottom surface of the finger(20) and support elastically the rotation of the finger(20) according to the volume of the selected hair.

The lower clip piece(50) corresponding to the upper clip piece(10) has a curve-shaped second curvature portion(51) toward the pressing member(30), brackets(52) with a torsion spring(S) installed elastically and rotatably to the brackets (13) of the upper clip piece(10) on one side of the second curvature portion(51) and joint holes(52*a*), through which a rivet(R) pass and can be jointed, a supporting plate(53) corresponding to the pressing plate(12) of the upper clip piece (10).

In a hair clip, as an another exemplary embodiment according to the present invention, the finger(20) is formed in one united body to the upper clip piece(10) and, in order to rotate the finger(20) from the first curvature portion(11) of the upper clip piece(10), an arc-shaped curvature portion(14) with small thickness of section on the middle place is formed in one united body to the upper clip piece.

Furthermore, in the hair clip(1), the coupling of the upper clip piece and the finger(20) can be shown in the following exemplary embodiment.

A curvature part(16) with a guide protrusion(16*a*) protrudly formed at one end is provided on the end portion of the first curvature portion(11) and an insertion hole(24) is formed at the one end of the finger(20) in order to receive the curvature part(16), and an arc-shaped long hole(25) for guiding the guide protrusion(16*a*) is formed on one part, and a compressive coil spring(S1) is installed to be inserted into the insertion hole(24) of the finger(20) in order to adjust elastically the length of the finger(20) sliding from the curvature part(16) of the upper clip piece(10) according to the volume of hair selected from the bottom surface of the pressing member(20).

On the one hand, coupled parts(17) with coupled holes (17*a*) are formed facing each other on the both sides of one end of the first curvature portion(11) and, on the other hand, coupled parts(26) with coupled holes(26*a*) are formed on the one end of the finger(20) in order to correspond to the coupled part(17), and a pair of male and female rivets(R1) are installed through the coupled holes(17*a*)(26*a*) on the coupled parts(17) (26), and a torsion spring(S2) is installed on the axis of the rivet(R1) in order to support elastically the rotation of the finger(20) from the upper clip piece(10).

Meanwhile, the pressing member(30) according to the present invention can be installed elastically from the supporting plate(53) of the lower clip piece(50) as follows.

Here, the one end of the pressing member(30) is inserted into the catching part(23) and the rear end is supported elastically to the lower clip piece.

Further, a fixed pin(53*a*) is formed in one united body to the one end of the support plate(53) of the lower clip piece(50), and one end of a tension coil spring(S3) is combined with the fixed pin(53*a*) and the other end is combined with the rear end of the pressing member(30) in order to support elastically the pressing member(30).

Furthermore, a fixed axis(53*c*) is formed on one end of the support plate(53) of the lower clip piece(50) in order to fix a torsion spring(S4), and a fixed pin(53*a*) is formed to support the one end of the torsion spring(S4), and a fixed protrusion (37) is formed in one united body to the one rear end of the pressing member(30) in order to support the other end of the torsion spring(S4) and so the pressing member(30) can be supported elastically.

The operation and effect of the hair clip for beauty shop according to the present invention can be explained as below.

Firstly, using more than one hair clips(1) to hold hair, let s make an experiment to maintain hair shape at random or to fix in shape to be trimmed.

In general, pressing with finger the pressing plate(12) of the upper clip piece(10) and the supporting plate(53) of the lower clip piece(50), the upper clip piece(10) and the lower clip piece(50) are opened around the axis of the rivet(R).

Here, in a state that the upper clip piece(10) and the lower clip piece(50) are opened through twisting of the torsion spring(S) mounted on the axis of the rivet(R), let s put the part of the lower clip piece(50) into between hair along the curved line of head to choose hair.

The volume of selected hair is decided between the first curvature portion(11) of the upper clip piece(10) and the second curvature portion of the lower clip piece(51).

Releasing the hand from the pressing plate(12) and the supporting plate(53), through the restoring force of the torsion spring(S) the first curvature portion(11) of the upper clip piece(10) get contacted to the second curvature portion(51) of the lower clip piece(50) and then hair selected by the pressing member(30), the variable spring(40) and the finger(20) installed between them can be held firmly.

The pressing member(30), which is made through molding of the soft synthetic resin, as illustrated in FIG. 6, has flexible shape and presses to hold hair in a state that selected hair is covered lightly from the upper part.

According to the volume of selected hair at this time, the pressing member(30) presses hair in curved-shape. Here, the support projection(32), the other end of the pressing member (30), is supported from the bottom surface of the protrusion (12*a*) of the upper clip piece(10).

In pressing hair using the pressing member(30), the pressing member becomes to have arc-shape, and the support protuberance axis(31) of the pressing member(30) connected from the support holes(22) of the finger(20) plays role to press the pressing member(30) through rotation of the fixed shaft (21) of the finger(20) from the hinge holes(11*a*) of the upper clip piece(10).

In the meantime, as illustrated in attached FIG. 7 as an example according to the present invention, hair can be selected and held in the same way as explained in the above by molding the finger(20) in one united body to the pressing member(30) and installing to connect it to the upper clip piece(10).

That is, in holding selected hair firmly with the pressing member(30) like in the above, the finger(20) operates in such shape as bending finger joint and presses to support the pressing member(30), having selected hair, still more firmly and to prevent hair from falling away from the hair clip(1).

As in the above, through the bending operation of finger (20), the variable spring(40) installed on the spring support holes(11*b*) of the upper clip piece(10) is pressed and the pressing member(30) is supported.

The variable spring(40) with U-shape, each connected end portions of which have deflection, can give the elasticity to the rotating portions by such shape as a twisted spring through the deflection between the connecting places.

Further, the support convex parts(33) of the pressing member at regular intervals and with curved-shape hold selected hair firmly.

After all, the pressing member is an essential part which can overcome the difference of interval degree occurring to the installation of the brackets(13)(52) of the upper clip piece (10) and the lower clip piece(50) and plays role in holding hair firmly.

Accordingly, the stable selection of hair has effect in enabling hairdresser do his job conveniently.

Furthermore, a hair clip(1) of an exemplary embodiment according to the present invention is illustrated in the accompanied FIG. 8.

The elementary operation of the above hair clip(1) is the same case as in the above explained hair clip but there are slight difference in degree of connection of the pressing member(30) to the upper clip piece(10) and the finger(20).

The joint hole(35) formed in the front of the pressing member(30) is fixedly inserted into the catching part(23) of the finger(20), and in the state that the support protuberance axis(36) formed in the opposite side is passed through the insertion support hole(12*b*) formed in the upper clip piece (10) from the bottom surface to the upper surface so that the both end portions of the support protuberance axis(36) can be caught and the both end portions of the pressing member(30) are installed, the above explained operation can work.

The holding of hair using the pressing member like in the above is illustrated in the attached FIG. 12.

In the state that hair is placed between the above pressing member(30) and the lower clip piece(50), the support convex parts(33) and the hemisphere protrusions(34) of the pressing member are pressing to hold hair.

Further, in an exemplary embodiment according to the present invention, as illustrated in the attached FIG. 13, the support of the pressing member(30) can be realized equally by forming the finger(20) in one united body to the upper clip piece(10).

That is, the arc-shaped curvature portion(14) and the finger (20) are formed toward upside from the first curvature portion (11) to the upper part.

The arc-shaped curvature portion(14) can bend the finger (20) connecting the joint holes(35) of the pressing member (30) by forming the thickness of the central section thin.

Molding the finger(20) and the upper clip piece(10) in one united body can get merits in reducing the mold-cost occurring to molding the components and in omitting the assembly-relation.

Meanwhile, in exemplary embodiments according to the present invention, as illustrated in the attached FIGS. 14 and 15, the finger(20) is inserted into the curvature part(16) formed in the end portion of the first curvature portion(11) of the upper clip piece and is slid along the curvature part(16) and then the finger(20) is bent against the upper clip piece and so can support the pressing member(30) selecting hair.

The guide protrusion(16*a*) formed on the curvature part (16) is guided into the insertion hole(24) of the finger(20) compulsorily and then guided by the arc-shaped long-hole (25) formed on the one part.

The restoring force according to the degree of bending of the finger(20) against the curvature part(16) is elastically supported by the compressive coil spring(S1) supporting the end part of the curvature part(16) through the insertion hole (24) and then can support the pressing member(30).

Meanwhile, as illustrated in the FIGS. 16 and 17 attached as exemplary embodiments according to the present invention, the finger(20) can be bent by using the hair clip(1) including the male and female rivet(R1) and the torsion spring(S2) on the rivet(R1) through the coupled holes(17*a*) (26*a*) from the both end portions of the first curvature portion (11) of the upper clip piece(10) and the coupled parts(17)(26) of the finger(20).

The operation of the pressing member(30) transformed to the arc-shape while pressing hair naturally according to the selection of hair against the upper clip piece(10) has all possibility of rotating, bending and sliding of the finger(20).

Further, holding of hair can be realized much more firmly by providing the pressing member(30) selecting and holding hair, like in the above, with more elasticity.

That can be possible by supporting elastically the rear end of the pressing member, as illustrated in the attached FIG. 18 and FIG. 19.

As illustrated in the attached FIG. 18, the tension coil spring(S3) is connected to the rear end of the pressing member(30) and the opposite end is connected to the fixed pin (53*a*) positioned on the inner part of the supporting plate(53) of the lower clip piece placed in the same direction, and so the elastic installation of the pressing member can be realized.

Furthermore, in illustrated in FIG. 19, the one end of the torsion spring(S4) is connected to the fixed protrusion(37) positioned on the rear end of the pressing member(30) on the one hand and the torsion spring(S4) is connected to the fixed axis(53*c*) and the fixed pin(53*a*) mounted on the inner part of the supporting plate of the lower clip piece on the other hand, and then the pressing member(30) can be provided with the elasticity like explained in the above.

The elastic force of the above pressing member(30) can realize firm holding of hair in so much as hair do not get any damage, by supporting the one end of the pressing member selecting and pressing hair through using the elasticity of the tension coil spring(S3) or the torsion spring(S4).

The invention claimed is:

1. A hair clip for beauty shop comprising:

an upper clip piece(10) having:

a convex shaped first curvature portion having a proximal and distal end; said first curvature portion having a pair of hinge holes (11*a*) located on opposite sides at the distal end thereof and a pair of spring support holes (11*b*), one located proximal each of the hinge holes;

a pressing plate (12) located adjacent to the proximal end of the first curvature portion (11) having a recess in a bottom surface thereof adjacent the proximal end of the first curvature portion and a protrusion (12*a*) extending upwardly from a top surface opposite the recess; and a pair of brackets extending downwardly from and located on opposite sides of the pressing plate (12) adjacent the protrusion (12*a*), each having a joint hole (13*a*) extending there through;

a finger (20) having a pair of fixed shafts (21) at a proximal end thereof, said shafts facing toward each other from opposite sides of the finger, said shafts being inserted into the hinge holes (11*a*) on the upper clip piece (10); and a pair of support holes (22) disposed on opposite sides medially of the finger;

a pressing member (30) having a rectilinear shape; a support protuberance (31) extending transversely across and outwardly from a distal end of the pressing member and engaging the support holes (22) of the finger (20); a support projection (32) located on an upper surface of the pressing member at a proximal end thereof engaged in the recess in the upper clip piece (10); a number of support convex parts (33) on the bottom surface of the pressing member (30) along its length for holding hair;

a substantially U-shaped spring (40) having two ends, each end mounted in a respective spring support hole (11*b*) of the upper clip piece (10), said spring being biased toward a bottom surface of the finger (20) to support the biased rotation of the finger (20) according to the volume of hair;

a lower clip piece (50) comprising: a convex-shaped second curvature portion (51) corresponding to the first curvature portion of the upper clip piece (10) having a pair of brackets (52), each having joint holes (52*a*) extending therethrough, extending upwardly from opposing sides of a proximal end of the lower clip piece; and a supporting plate (53) located adjacent the proximal end of the lower clip piece (50) corresponding to the pressing plate (12) of the upper clip piece (10);

a torsion spring (S) located between the brackets (13) of the upper and lower clip pieces; and a rivet (R) extending through the spring (S) and engaging the holes (13*a* and 52) in the brackets of the upper and lower clip pieces.

2. The hair clip as claimed in claim 1, wherein the pressing member(30) is made of a soft synthetic resin and support convex parts(33) at regular intervals are formed in curved-shape, and a number of hemispheric protrusions(34) are formed in a bottom surface of the length-direction.

3. The hair clip as claimed in claim 1, wherein according to forming of the position of the spring support holes(11*b*), each parts of the U-shaped spring (40) are formed with different lengths.

4. The hair clip as claimed in claim 1, wherein the finger (20) is formed in an end part of the pressing member(30).

5. A hair clip for beauty shop(1) comprising:

an upper clip piece(10) having:

a convex shaped first curvature portion having a proximal and distal end; said first curvature portion having a pair of hinge holes (11*a*) located on opposite sides of a distal end thereof; and a pair of spring support holes (11*b*), one located proximal each of the hinge holes;

a pressing plate (12) located adjacent to the proximal end of the first curvature portion (11) having an insertion hole (12*b*) located adjacent the proximal end of the first curvature portion;

a pair of brackets (13) extending downwardly from and located on opposing sides of the pressing plate (12), adjacent the insertion hole, each bracket having a joint hole (13*a*) that extends there through;

a finger (20) having a pair of fixed shafts (21) at a proximal end thereof, said shafts facing toward each other from opposing sides of the finger, said shafts being inserted into the hinge holes (11*a*) of the upper clip piece (10); a catching part (23) extending transversely across a distal end of the finger and being formed as a concave recess on the finger;

a pressing member (30) having a rectilinear shape; a joint hole (35) located on a distal end of the pressing member, receiving the distal end of the finger (20) engaging the catching part (23); a support protuberance (36) extending transversely across and outwardly from a proximal end of the pressing member, and through the insertion hole (12*b*) of the upper clip piece (10), a number of support convex parts (33) located on an underside of the pressing member (30) along its length for holding hair;

a substantially U-shaped spring (40) having two ends, each end mounted in a respective spring support hole (11*b*) of the upper clip piece (10), said spring being biased toward a bottom surface of the finger (20) to support the biased rotation of the finger (20) according to the volume of hair;

a lower clip piece (50); a convex-shaped second curvature portion (51) corresponding to the first curvature portion of the upper clip piece (10); having a pair of brackets (52) each having joint holes (52*a*) extending there through, extending outwardly from opposing sides of a proximal end of the lower clip piece; and a supporting plate (53) located adjacent the proximal end of the lower clip piece (50) corresponding to the pressing plate (12) of the upper clip piece (10);

a torsion spring (S) located between the brackets (13) of the upper and lower clip pieces; and a rivet (R) extending through the spring (S) and the holes (13*a* and 52) in the brackets of the upper and lower clip pieces.

* * * * *